US005243740A

United States Patent [19]

Wakabayashi

[11] Patent Number: 5,243,740

[45] Date of Patent: Sep. 14, 1993

[54] BUCKLE FOR PREVENTING SLIPPAGE AND WRINKLING OF A BELT

[75] Inventor: Masao Wakabayashi, Toyama, Japan

[73] Assignee: Yoshida Kogyo K. K., Tokyo, Japan

[21] Appl. No.: 919,493

[22] Filed: Jul. 24, 1992

[30] Foreign Application Priority Data

Jul. 25, 1991 [JP] Japan ..... 3-65883[U]
Jul. 25, 1991 [JP] Japan ..... 3-65884[U]

[51] Int. Cl.[5] ..... A44B 11/00

[52] U.S. Cl. ..... 24/170; 24/191; 24/193

[58] Field of Search ..... 24/170, 191, 193, 585

[56] References Cited

U.S. PATENT DOCUMENTS

| | | | |
|---|---|---|---|
| 764,065 | 7/1904 | Mitchell | 24/193 |
| 1,313,210 | 8/1919 | Ross | 24/170 |
| 4,727,628 | 3/1988 | Rudholm | 24/170 |
| 4,733,440 | 3/1988 | Ogawa | 24/170 |

FOREIGN PATENT DOCUMENTS

| | | | |
|---|---|---|---|
| 0181084 | 5/1986 | European Pat. Off. . | |
| 0128584 | 3/1902 | Fed. Rep. of Germany | 24/170 |
| 49-8858 | 3/1974 | Japan . | |
| 57-107412 | 7/1982 | Japan . | |
| 60-91028 | 6/1985 | Japan . | |
| 62-98507 | 6/1987 | Japan . | |
| 63-5530 | 2/1988 | Japan . | |
| 63-8272 | 3/1988 | Japan . | |
| 55-9212 | 2/1990 | Japan . | |
| 2-84507 | 6/1990 | Japan . | |
| 2-105713 | 8/1990 | Japan . | |
| 57-142930 | 9/1992 | Japan . | |
| WO87/02552 | 5/1987 | PCT Int'l Appl. . | |
| 0215429 | 9/1967 | Sweden | 24/193 |
| 330808 | 6/1930 | United Kingdom . | |
| 404084 | 1/1934 | United Kingdom . | |
| 468873 | 7/1937 | United Kingdom . | |
| 0838178 | 6/1960 | United Kingdom | 24/193 |
| 945076 | 12/1963 | United Kingdom . | |
| 1551241 | 8/1979 | United Kingdom . | |

*Primary Examiner*—Victor N. Sakran
*Attorney, Agent, or Firm*—Hill, Steadman & Simpson

[57] ABSTRACT

A buckle comprising a rectangular frame including a pair of lateral frame members and a pair of first and second longitudinal frame members interconnected therewith and a substantially rectangular belt stopper pivotally mounted on the lateral frame members with a belt interposed between the belt stopper and the longitudinal frame members. As the belt stopper turns in one direction, one side of the belt stopper brings the belt into pressing engagement with the inner edge of the first longitudinal frame member.

7 Claims, 6 Drawing Sheets

BUCKLE FOR PREVENTING SLIPPAGE AND WRINKLING OF A BELT

BACKGROUND OF THE INVENTION

1. Field of the Invention

The present invention relates to a buckle for a trench coat, a rain coat, or the like garments in which garments the buckle is less subject to forces in use but it must have great decorative effect.

2. Description of the Prior Art

The typical buckle of the kind described is shown in FIG. 12. Obviously, such a buckle is very simple in construction and comprises a flat rectangular frame comprising a pair of upper and lower rails and three parallel crossbars extending therebetween to be interconnected with the rails. One end of the belt is fastened to the middle crossbar and, after the belt is wound around the waist of the wearer, the other end portion of the belt passes through between one end cross bar and the middle crossbar from the rear side of the buckle and then lies flatly over the middle crossbar and eventually passes through between the other end cross bar and the middle crossbar. Then, the belt is made taut to adjust to the size of the waist of the wearer. This is the traditional way of using the buckle of this type.

Although advantageous in being very simple in construction and less in manufacturing cost, the conventional buckle suffers the following drawbacks. Since there is a large distance between the middle crossbar and both end crossbars, the fabric belt is liable to move therebetween and wrinkle, thus rendering the garment as a whole unsightly.

Furthermore, since the fabric belt is inclined to slip between the crossbars intrinsically, the belt will become loosened.

SUMMARY OF THE INVENTION

With such drawbacks in view, it is an object of the present invention to provide a buckle which is constructed to prevent the belt from slipping and to prevent the belt from wrinkling.

According to the present invention, there is provided a buckle for fastening a belt comprising a substantially rectangular frame including a pair of lateral frame members and a pair of longitudinal frame members connected thereto, a substantially rectangular belt stopper including a pair of aligned axles one on each end thereof, and means for pivotally mounting the axles one in each lateral frame member with the belt interposed between the belt stopper and the longitudinal frame members, so that a rotation of the belt stopper in one direction causes one side of the belt stopper to bring the belt into pressing engagement with the inner edge of the corresponding longitudinal frame member.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 1:
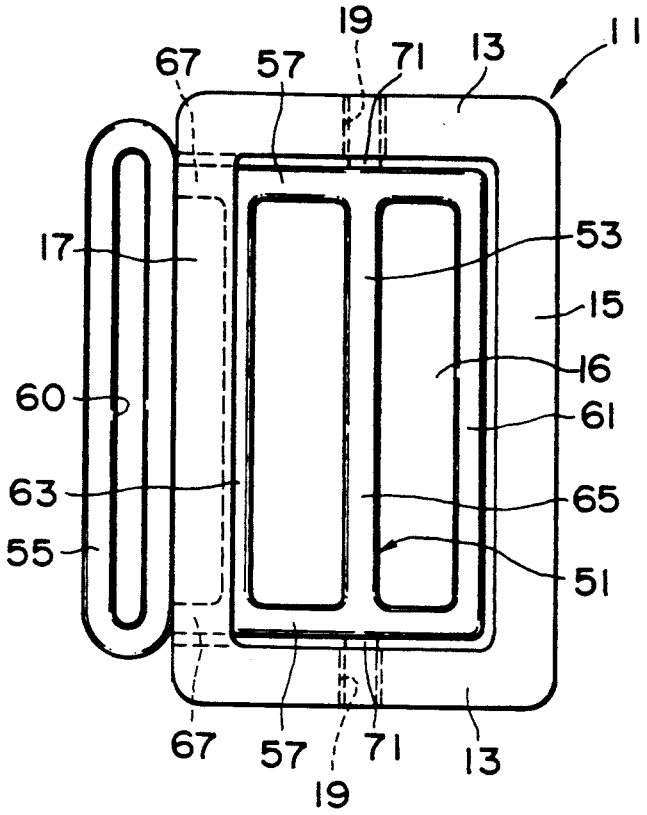
FIG. 1 is a front view of a buckle according to this invention.
Figure 2:
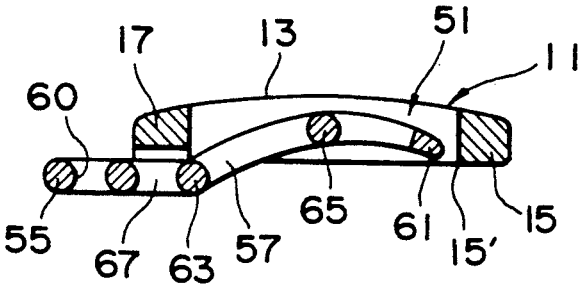
FIG. 2 is a lateral cross-sectional view of the buckle of FIG. 1.
Figure 3:
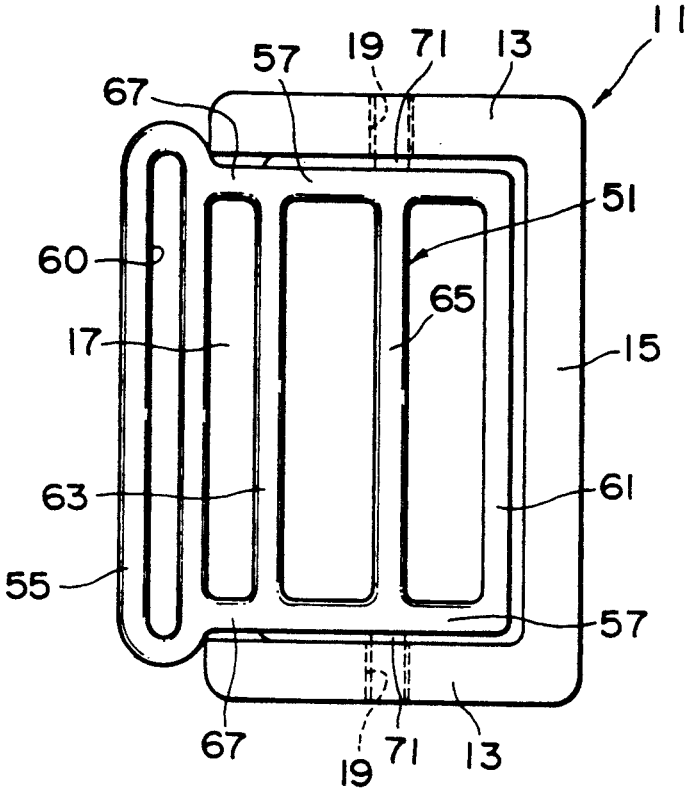
FIG. 3 is a rear view of the buckle of FIG. 1.

FIGS. 1 through 3 shows a buckle according to the present invention, which may be made of either metal or plastic and which is used for adjustably fastening a belt 81 for a trench coat, a rain coat or the like garments. The buckle broadly comprises a substantially rectangular frame 11, a substantially rectangular belt stopper 51 pivotally mounted on the frame 11 and a belt-attaching portion 55 provided on one side of the belt stopper 51, as closely set forth hereinbelow.

As better shown in FIG. 1, the rectangular frame 11 comprises a pair of parallel lateral frame members 13, 13 and a pair of parallel first and second longitudinal frame members 15, 17 each connected at its opposed ends with the corresponding ends of the lateral frame members 13, 13, thus leaving a substantially rectangular opening 16 therebetween. The opposed lateral frame members 13, 13 have a pair of through circular holes 19, 19 formed through the middle thereof and arranged in alignment with each other.

Figure 4:
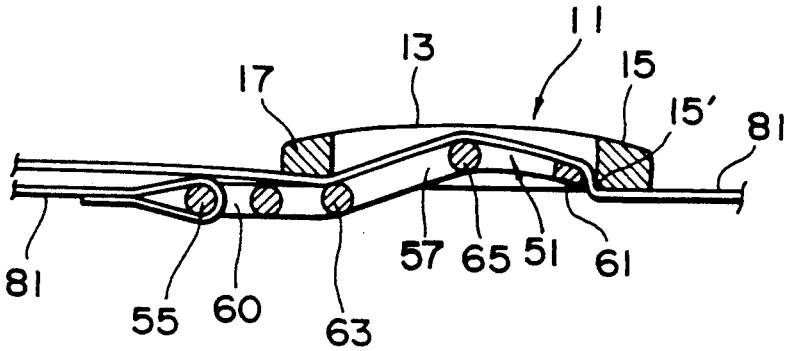
FIG. 4 is a view similar to FIG. 2 but showing the buckle having a belt attached thereto.

As better shown in FIG. 3, the rectangular belt stopper 51 is slightly less in size than the rectangular opening 16. The belt stopper 51 is in the shape of a grid and comprises a pair of parallel upper and lower rails 57, 57 and three parallel crossbars—a distal crossbar 61 a middle crossbar 65 and a proximal crossbar 63 as viewed right to left in FIGS. 1 and 2—running between the upper and lower rails 57, 57. As shown in FIG. 4, each of the upper and lower rails 57, 57 is arcuate. The distal crossbar 61 has its opposed ends connected with the ends of the upper and lower rails 57, 57. The middle crossbar 65 is disposed substantially in the middle between the proximal and distal crossbars 61, 63. A pair of aligned axle portions 71 are provided one on each of the rails 57, 57 in alignment with the middle crossbar 65.

As shown in FIGS. 1 through 3, the belt-attaching portion 55 is in the shape of an elongated loop having a belt-attaching slot 60. The belt-attaching portion 55 is connected to the proximal crossbar 63 through a pair of extensions 67, 67 of the upper and lower rails 57, 57. The length of belt-attaching slot 60 is substantially equal to the distance between the lateral frame members 13, 13. This advantageously makes it possible to use on this buckle a belt of a width substantially equal to the distance between the lateral frame members 13, 13, so that the buckle and the belt could go very well aesthetically.

As better shown in FIGS. 1 and 3, the belt stopper 51 is pivotally mounted on the frame 11 by fitting the axles 71, 71 into the opposed holes 19, 19 with the arcuate rails 57, 57 substantially lying within the opening 16. The belt-attaching portion 55 extends beyond the second longitudinal frame member 17.

As shown in FIG. 4, one end of the belt 81 is fastened to the belt-attaching portion 55. After the belt is wrapped around, for example, the waist of the wearer, the other end of the belt 81 passes between the first longitudinal frame member 15 and the distal crossbar 61, then lies flatly over the middle crossbar 65 and then between the second longitudinal frame member 17 and the proximal crossbar 63. As the belt is tightened, so the belt stopper 51 turns clockwise as viewed in FIG. 4 on the axle portions 71, 71 due to the pressure of the wearer exerted against the proximal crossbar 63 and the belt-attaching portion 55. As a result of the rotation of the belt stopper 51, the distal crossbar 61 brings the belt 81 into pressing engagement with the inner edge 15' of the first longitudinal frame member 15, and at the same time, the proximal crossbar 63 brings the belt 81 into pressing engagement with the second longitudinal frame member 17.

FIGS. 5 through 8 show another embodiment which is substantially identical to the preceding embodiment except for the construction of pivotally mounting the axle portions 71 on the lateral frame members 13. Instead of the through holes 19 in the preceding embodiment, a pair of recesses 21 are formed one in each lateral frame member 13 in its rear side. Provision of the recess in the rear side of the frame member 13 advantageously prevents the recess from being exposed to view, thus augmenting the decorativeness of the buckle as a whole. As better shown in FIG. 8, a pair of first aligned complementary semicircular holes 23 are formed one in the bottom of each recess 21 so as to communicate with the corresponding recess 21. A pair of projecting studs 25, 27 are provided in the recess 21 one on each side of the first semicircular hole 23.

Figure 5:
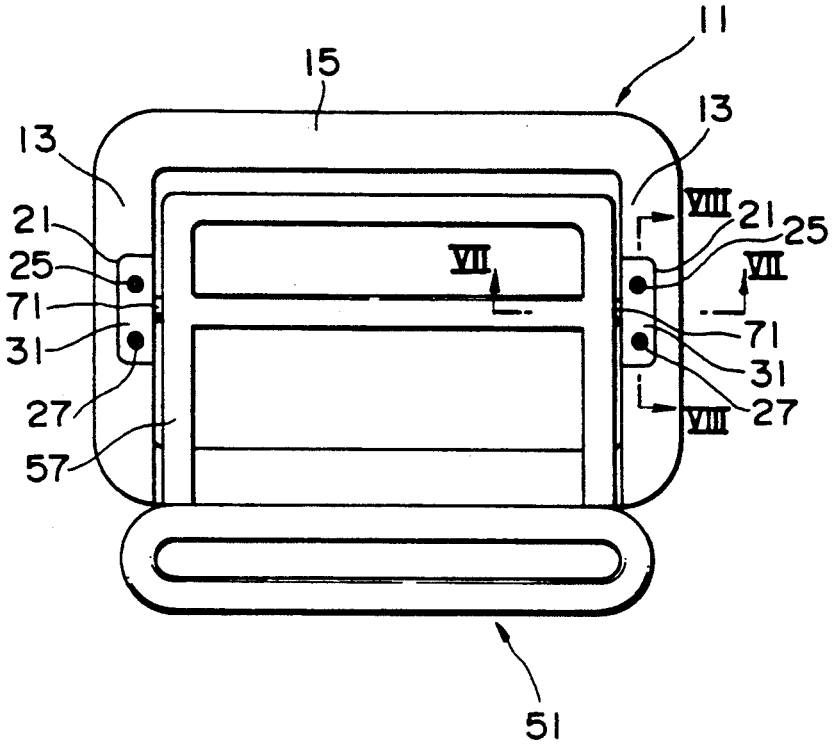
FIG. 5 is a rear view of a buckle according to another embodiment of the present invention.
Figure 6:
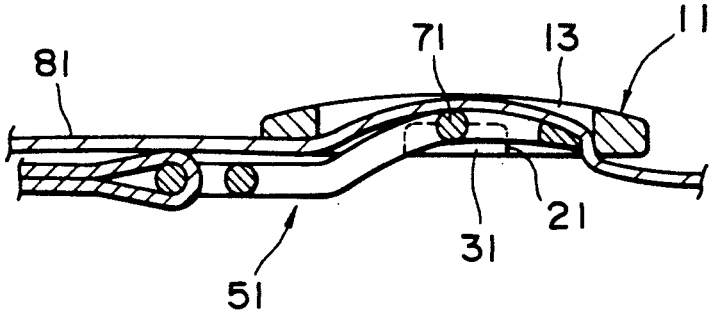
FIG. 6 is a view similar to FIG. 4 but showing the buckle according to the embodiment of FIG. 5.
Figure 7:
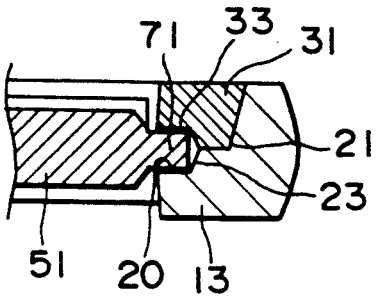
FIG. 7 is a cross-sectional view taken on line VII—VII of FIG. 5.
Figure 8:
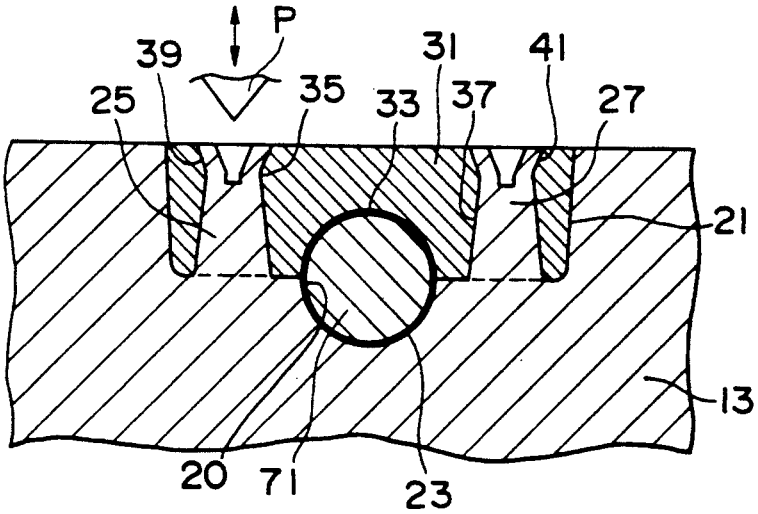
FIG. 8 is a cross-sectional view taken on line VIII—VIII of FIG. 5.

As shown in FIGS. 5 and 6, a pair of retaining plates 31 is each adapted to fit into the corresponding recess 21. As better shown in FIG. 8, each retaining plate 31 has a second complementary semicircular hole 33 in its lower side. When the retaining plates 31 fit into the recesses 21, the second complementary semicircular holes 33 define, with the first complementary semicircular holes 23, a pair of aligned circular holes 20, 20. A pair of bores 35, 37 are formed through the retaining plate 31 on the opposite sides of the semicircular hole 23. Each bore 35, 37 has a flared mouth 39, 41 open toward the upper side of the retaining plate 31. The retaining plates 31 fit into the recesses 21 with the studs 25, 27 piercing the cores 35, 37. Subsequently, as shown in FIG. 8, the top end of the studs 25, 27 are deformed, such as by a press machine P, against and clinched to the flared mouth 39, 41 so that the retaining plates 31, 31 are fastened to the recesses 21 with the opposed axle portions 71 pivotally mounted in the holes 20, 20. In case of the buckle being made of plastic, an ultrasonic horn may be used instead of the press machine P.

Figure 9:
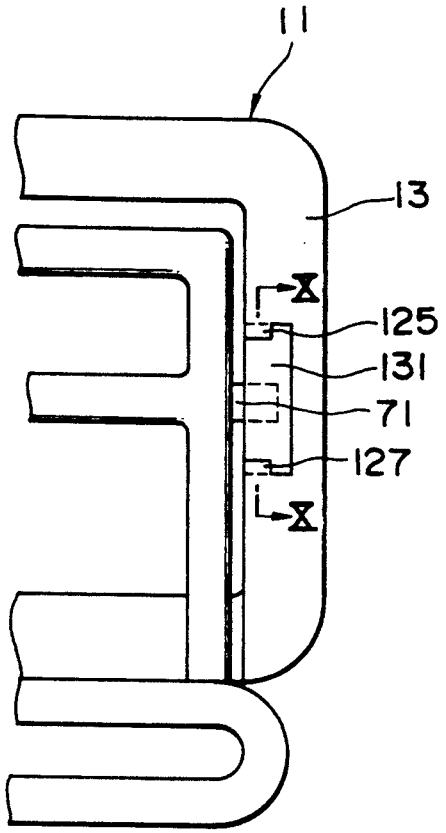
FIG. 9 is a fragmentary rear view of a buckle according to still another embodiment of the present invention.
Figure 10:
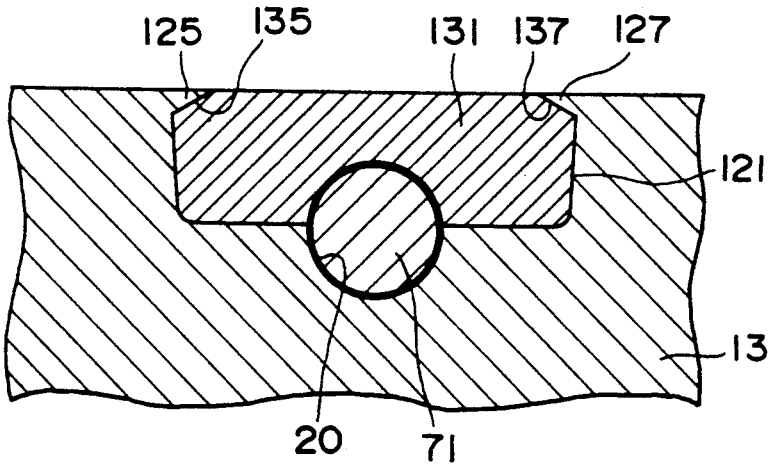
FIG. 10 is a cross-sectional view taken on line X—X of FIG. 9.
Figure 11:
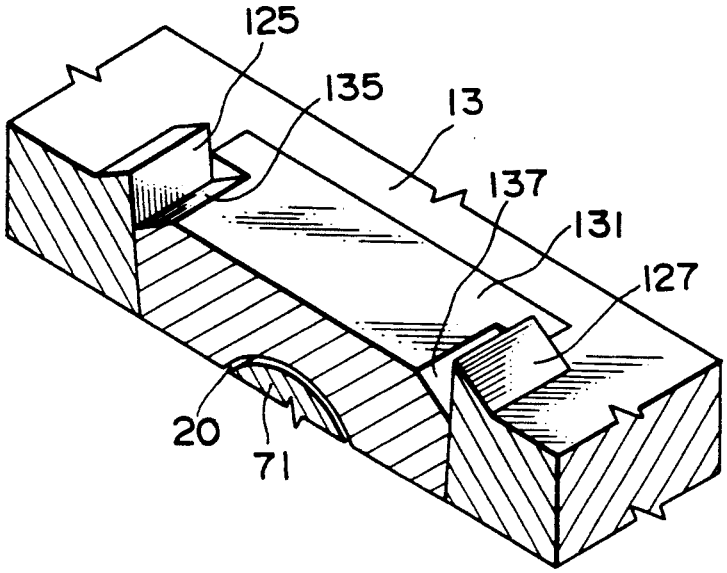
FIG. 11 is a fragmentary perspective, partly cross-sectional view of the part shown in FIG. 10.
Figure 12:
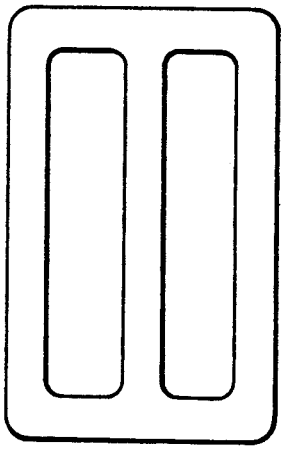
FIG. 12 is a front view of a conventional type buckle.

FIGS. 9 through 11 show still another embodiment which is substantially identical with the immediately preceding embodiment except for the construction of fastening the retaining plates 131 to the corresponding recesses. In this embodiment, as better shown in FIG. 11, a pair of protuberant lips 125, 127 are provided along the lateral edges of each recess 121. Correspondingly, a pair of chamfers 135, 137 are formed in the opposed sides of each retaining plate 131. After the retaining plate 131 is embedded in the recess 121, the protuberant lips 125, 127 are forged against the corresponding chamfers 135, 136, respectively so that the retaining plates 131, 131 are fastened to the recesses 121 with the opposed axles 71 pivotally mounted in the holes 20, 20.

In the preceding embodiments, the retaining plates 131, 131 are fastened to the recesses 21, 121 by clinching or forging. However, such fastening methods may be replaced by adhesive. Alternatively, adhesive may be used together with either clinching or forging and obtain increased fastening effects.

Although the belt stopper 51 is shown to be shaped as a grid in the preceding embodiments, it may be a single rectangular plate as long as it can be pivotally mounted on the frame 11 and is constructed to accomplish the same effects.

With the construction of the invention as set hereinabove, the belt can be firmly retained to the buckle against slipping thereoff.

Furthermore, since being made taut by the belt stopper, the belt is quite immune from wrinkling.

Still furthermore, it is very easy to assemble the belt stopper on the frame.

Yet furthermore, the buckle has no recesses exposed to the front for pivotally mounting the belt stopper, and therefore, it is very sightly.

Obviously, the skilled person would realize that various modifications and variations of the present invention are possible in the light of the above teaching. It is therefore to be understood that within the scope of the appended claims the invention may be practiced otherwise than as specifically described, and that the invention is not limited to the embodiments described above in detail.

What is claimed is:

1. A buckle for fastening a belt comprising a substantially rectangular frame including a pair of lateral frame members and a pair of first and second longitudinal frame members connected thereto, a substantially rectangular belt stopper having an axle extending longitudinally thereof, and means for pivotally mounting the axle in the lateral frame members with the belt interposed between the belt stopper and the longitudinal frame members, a rotation of the belt stopper in one direction causing one side of the belt stopper to bring the belt into pressing engagement with the inner edge of the first longitudinal frame member, the belt stopper further having a belt-attaching portion on the other side thereof.

2. A buckle according to claim 1, the rotation of the belt stopper in said one direction causing the other side of the belt stopper to bring the belt into pressing engagement with the second longitudinal frame member.

3. A buckle according to claim 1, wherein the belt-attaching portion extends beyond the said second longitudinal frame member.

4. A buckle according to claim 1, the axle-mounting means comprising a pair of aligned holes formed one in each of the lateral frame members for receiving the axle of the belt stopper.

5. A buckle according to claim 1, the axle-mounting means comprising a pair of recesses formed one in each lateral frame member; a pair of first aligned complementary semicircular holes each communicating with the corresponding recess; a pair of retaining plates each having a second complementary semicircular hole and fitting into the recess so that the second complementary semicircular holes define, with the first complementary semicircular holes, a pair of aligned circular holes for receiving the axle of the belt stopper; and means for fastening each retaining plate to the corresponding recess.

6. A buckle according to claim 5, the fastening means comprising a pair of projecting studs provided in the recess one on each side of the first semicircular hole and a pair of bores formed in the retaining plate one on each side of the second semicircular hole and each having a flared mouth, the studs piercing the bores and being clinched to the flared mouths

7. A buckle according to claim 5, the fastening means comprising a pair of projecting lips provided one along each lateral edge of each recess and a pair of chamfers formed one in each side of each retaining plate, the protuberant lips being forged against chamfers after the retaining plate is fit into the recess.

* * * * *